US010994284B2

(12) United States Patent
Mankosa et al.

(10) Patent No.: US 10,994,284 B2
(45) Date of Patent: May 4, 2021

(54) MULTI-STAGE FLUIDIZED-BED FLOTATION SEPARATOR

(71) Applicant: Eriez Manufacturing Co., Erie, PA (US)

(72) Inventors: Michael J. Mankosa, Erie, PA (US); Jaisen N. Kohmuench, Erie, PA (US); Eric S. Yan, Erie, PA (US)

(73) Assignee: Eriez Manufacturing Co., Erie, PA (US)

( * ) Notice: Subject to any disclaimer, the term of this patent is extended or adjusted under 35 U.S.C. 154(b) by 180 days.

(21) Appl. No.: 15/537,326

(22) PCT Filed: Dec. 17, 2015

(86) PCT No.: PCT/US2015/066447

§ 371 (c)(1),
(2) Date: Jun. 16, 2017

(87) PCT Pub. No.: WO2016/100704

PCT Pub. Date: Jun. 23, 2016

(65) Prior Publication Data

US 2018/0050346 A1 Feb. 22, 2018

Related U.S. Application Data

(60) Provisional application No. 62/093,142, filed on Dec. 17, 2014.

(51) Int. Cl.
*B03D 1/14* (2006.01)
*B03D 1/24* (2006.01)

(52) U.S. Cl.
CPC ..... *B03D 1/1406* (2013.01); *B03D 1/1443* (2013.01); *B03D 1/24* (2013.01)

(58) Field of Classification Search
CPC ..... B03D 1/14; B03D 1/1406; B03D 1/1443; B03D 1/1456; B03D 1/1468; B03D 1/1481; B01F 3/04; B03B 5/28; C02F 1/24
See application file for complete search history.

(56) References Cited

U.S. PATENT DOCUMENTS 7,886,913 B1 * 2/2011 Fritz ..... B03C 1/247 209/214
2005/0045535 A1 * 3/2005 Fendley ..... B01D 21/0039 210/97
2008/0251427 A1 * 10/2008 Mankosa ..... B03D 1/22 209/164

OTHER PUBLICATIONS

Wikipedia, "Froth Flotation" https://en.wikipedia.org/wiki/Froth_flotation#Roughing on p. 7/Pr2-Pr4 and p. 7/Pr8-Pr10.

(Continued)

*Primary Examiner* — Patrick Orme
(74) *Attorney, Agent, or Firm* — Jonathan M. D'Silva; MMI Intellectual Property

(57) ABSTRACT

A system for concentrating particulate mixtures of hydrophobic and hydrophilic material in a fluid medium is presented. The system comprises a separation chamber comprising three or more processing compartments in series. Each processing compartment comprises a manifold for the introduction of teeter water that comprises a mixture of water and air bubbles, suspended solids that form a fluidized bed that is created by the upward movement of the teeter water through the suspended solids; and each processing compartment is independently operable. An overflow launder is located above the separation chamber and a dewatering compartment is located beneath the separation chamber.

16 Claims, 11 Drawing Sheets

(56) References Cited

OTHER PUBLICATIONS

911 Metallurgist, "Flotation Conditioning" https://www.911metallurgist.com/blog/flotation-conditioning (2016) on p. 1/Pr1-p. 2/Pr1.
"Teetering" by Epstein, Norman, published in Powder Technology, vol. 151, Issues 1-3, found at https://www.sciencedirect.com/science/article/abs/pii/S0032591004004942?via%3Dihub (Mar. 1, 2005, pp. 2-14).
"Separation of small particles due to density differences in a CFB riser system" by Regester, Jeremy L., (2004). Graduate Theses, Dissertations, and Problem Reports. 1458. https://researchrepository.wvu.edu/etd/1458 on p. 2/Pr1 and p. 27/Pr2.
"Introduction to Fluidization" by Coco, Ray, Kam, S.B. Reddy, and Knowlton, Ted, American Institute of Chemical Engineers (2014), pp. 21-22.
Chapter 12, Diffusion and Reaction in Porous Catalysts, Professional Reference Shelf, umich.edu/~elements/12chap/html/12prof2a.htm (2008), p. 1/Pr2.
"Investigation of the Segregation of Binary Mixtures with Iron-Based Particles in a Bubbling Fluidized Bed" by Turrado, Sandra, Fernandez, Jose Ramon, and Abanades, Juan Carlos, ACS Omega 2019, 4, 5, 9065-9073, Publication Date: May 23, 2019, https://doi.org/10.1021/acsomega.9b00674 ; https://www.ncbi.nlm.nih.gov/pmc/articles/PMC6647945/.

* cited by examiner

MULTI-STAGE FLUIDIZED-BED FLOTATION SEPARATOR

This application takes priority from U.S. Provisional Patent Application No. 62/093,142 filed on Dec. 17, 2014, and PCT Application No. PCT/US2015/066447 filed on Dec. 17, 2015, which are incorporated herein by reference.

BACKGROUND

Flotation separators are used to concentrate particulate mixtures of hydrophobic and hydrophilic material. Through the attachment of air bubbles, hydrophobic particles can be extracted from a solid/liquid mixture. What is presented is a flotation separation system that provides improved recovery in a multi-stage approach that allows for independent operation of each process stage that can be adjusted based on operating conditions.

SUMMARY

A system for concentrating particulate mixtures of hydrophobic and hydrophilic material in a fluid medium is presented. The system comprises a separation chamber comprising two or more processing compartments in series. Each processing compartment comprises a manifold for the introduction of teeter water that comprises a mixture of water and air bubbles, suspended solids that forms a fluidized bed (also known as teeter-bed or hindered-bed) that is created by the upward movement of the teeter water through the suspended solids, and each processing compartment is independently operable. An overflow launder is positioned above the separation chamber and a dewatering compartment is located beneath the separation chamber.

Some embodiments of the system comprise internal baffles that separate each processing compartment. In some embodiments, the dewatering chamber extends under every processing compartment in the separation chamber. In other embodiments, the dewatering chamber extends under only the last processing compartment in the series. Chemical additives may be added to one or more of the processing compartments. A first pressure transducer and a second pressure transducer may be used to control the density of the fluidized bed within the separation chamber. The processing compartments could be arranged in a non-linear series or in a straight line.

A method for concentrating mixtures of hydrophobic and hydrophilic particles in a fluid medium is also presented. In this method, particles and fluid medium are introduced into a separator system that comprises two or more processing compartments. Each processing compartment contains suspended solids that form a fluidized bed created by the upward movement of teeter water that comprises a mixture of water and air bubbles that move upward through the suspended solids. The particles are allowed to experience targeted separation conditions by adjusting the teetering condition in each processing compartment. The particles are permitted to interact with the fluidized bed and the air in the teeter water such that hydrophobic particles attach to the air bubbles and report to the upper portion of the separator system above the fluidized bed and hydrophilic particles pass through the fluidized bed and move into the lower portion of the separator system. An increased particle retention time is provided in the separator system by permitting the particles to move laterally and vertically through each processing compartment in the separator system. Hydrophobic particles are removed at the upper portion of the separator system and hydrophilic particles are removed at the lower portion of the separator system. Chemical additives may be added to one or more processing compartments.

BRIEF DESCRIPTION OF DRAWINGS

For a more complete understanding and appreciation of this invention, and its many advantages, reference will be made to the following detailed description taken in conjunction with the accompanying drawings.

Figure 1:
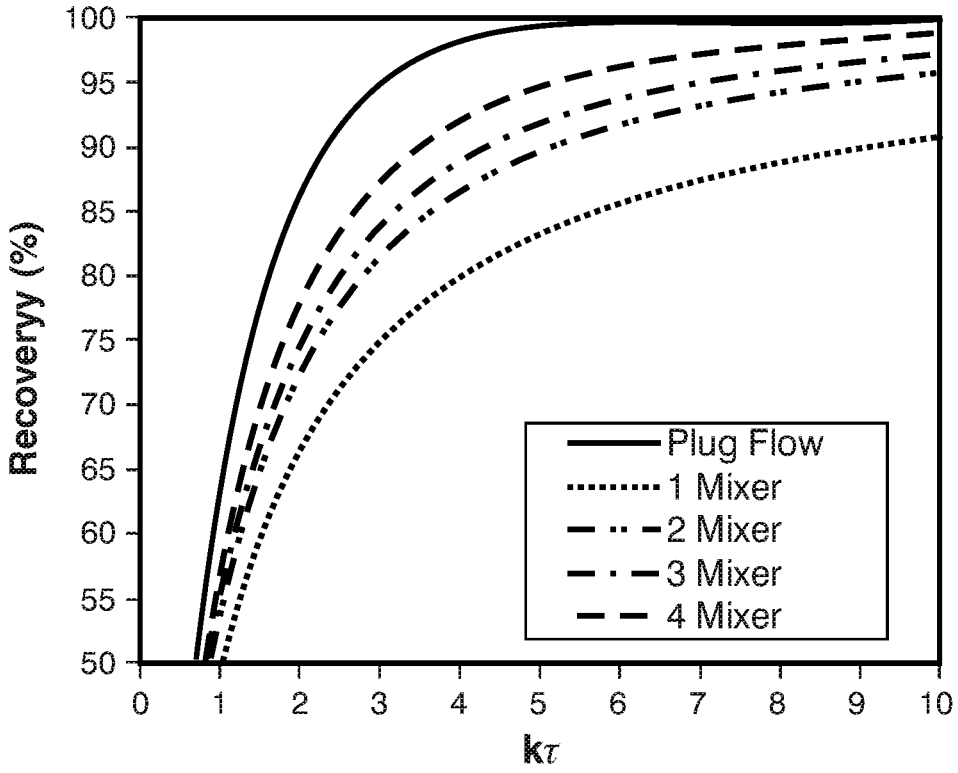
FIG. 1 is a chart that graphs recovery versus kT for various circuit configurations.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

DETAILED DESCRIPTION

Flotation separators are used to concentrate particulate mixtures of hydrophobic and hydrophilic material. Through the attachment of air bubbles, hydrophobic particles can be extracted from a mixture of hydrophobic and hydrophilic material in a fluid slurry that is typically water based. Recovery (R) of a particular species is predominantly controlled by three parameters: reaction rate, retention time and mixing conditions. This relationship is summarized in Eq. [1] as follows:

$$R \propto k\tau Pe \quad [1]$$

where, k is the reaction rate constant, and $\tau$ is the retention time. The Peclet number (Pe) quantifies the extent of axial mixing within the separation chamber. A higher value of Pe represents more plug flow conditions and, thus, improved recovery. Particulate movement in plug flow conditions move in vertical dimensions and are modelled that way to increase predictability of such systems. As shown in Equation [1], an increase in either parameter provides a corresponding increase in recovery.

Furthermore, it has been shown that the reaction rate can be described as:

$$k = P\left(\frac{3V_g}{2D_b}\right) \quad [2]$$

where $V_g$ is the superficial gas rate, $D_b$ is the bubble size, and P is the probability of attachment. It should be noted that the probability of attachment is a function of several other probabilities as shown in Equations [3] and [4] below, where:

$$P = P_c P_a (1 - P_d) \quad [3]$$

and:

$$P_c \propto \frac{C_i D_p}{D_b^2} \quad [4]$$

where $P_c$ is the probability of collision, $P_a$ is the probability of adhesion, and $P_d$ is the probability of detachment, C, is the particle concentration and $D_b$ is the particle diameter. $P_a$ is generally a function of chemistry and $P_d$ is related to turbulence. Inspection of these equations shows that the reaction rate for a separation process is increased for a system that utilizes high gas rates, small diameter bubbles, a high feed concentration, coarser particles, a high Peclet number (low axial mixing) and low turbulence.

Retention time is calculated by determining how long the particles are influenced by the flotation process. This parameter is typically calculated by dividing the volume of the cell (V), corrected for air hold-up (ε), and by the overall flow rate (Q) through the separator, as seen in Equation [5] below:

$$\tau = \frac{V(1-\varepsilon)}{Q} \quad [5]$$

and in Equation [6] below:

$$\varepsilon \propto \frac{V_g}{D_b} \quad [6]$$

The Peclet number is a function of gas and liquid velocities ($V_{g,1}$), cell height to diameter ratio (L:D) and air hold-up. It has been shown that the Peclet number for a flotation separator can be described as follows:

$$Pe \propto \left[\frac{V_i}{V_g}\right]\left[\frac{L}{D}\right]\left[\frac{1}{(1-\varepsilon)}\right] \quad [7]$$

Both column flotation separators and conventional flotation separators (otherwise known as "mechanical flotation cells") operate by exploiting the principles shown in the relationships presented in Equations [1] through [7]. These above equations provide an understanding of the fundamentals associated with operation of a single cell. In practice, however, conventional flotation separators operate exclusively as tanks-in-series while columns are typically installed in parallel circuit configurations. The fundamentals advantages of a tanks-in-series (otherwise known as "reactors-in-series") approach is well known. The premise is simple in concept: for an equivalent retention time, a series of perfectly mixed tanks will provide higher recovery than a single flotation separator. This point is illustrated by Equation [8] and the chart shown in FIG. 1, which shows recovery versus kT for various circuit configurations. These show the change in recovery as a function of the number of perfect mixers (N) for a system with a constant process rate (k) and retention time (τ):

$$R = 1 - \left(\frac{N}{N + k\tau}\right) \quad [8]$$

As shown in FIG. 1, increasing the number of mixers in series, at a constant value of kτ, results in an increase in recovery. For example, for a kτ value of 4, changing from one perfectly mixed tank to four tanks-in-series results in an increased flotation recovery of nearly 15%. This concept can be understood by examining the basic operation of a conventional flotation separator. Each flotation separator contains a mechanism (i.e. rotor and stator) that is used to disperse air and maintain the solids in suspension. As a result, each conventional flotation separator behaves substantially similar to a single perfectly mixed reactor. By definition, a perfectly mixed reactor (i.e. separator) has an equal concentration of material at any location in the system. As such, a portion of the hydrophobic material contained within the feed has an opportunity to immediately short circuit to the non-float stream. In a system using a single large conventional flotation separator, this would result in a loss of recovery. However, by discharging to a second conventional flotation separator, another opportunity exists to collect the bypassed floatable material. Likewise, this is also true with any additional third and fourth conventional flotation separator(s) in series. At some point, the law of diminishing returns will apply. In conventional flotation separators, this law typically applies after four or five flotation separator tanks-in-series. The recovery gain with each conventional flotation separator also requires additional energy.

Column flotation separators are also mixed separation chambers due to the flow characteristics of the air and feed slurry. Several investigations have examined the mixing characteristics of laboratory and industrial column flotation separators in mineral applications (Dobby and Finch, 1990, Yianatos et al, 2008). Results from these studies indicate that column fluid flotation separators operate between plug flow and perfectly mixed devices, depending on the application.

By applying the above flotation fundamentals, a multi-stage fluidized-bed flotation separator has been constructed. In a first embodiment, multiple fluidized-bed flotation chambers are essentially arranged in series such that feed material settling into an aerated fluidized bed of suspended solids, must traverse through several processing compartments (or "zones") that essentially create an in-series circuitry to mimic a plug-flow reactor. It should be understood that the multi-stage fluidized-bed flotation separator may otherwise be known as a "multi-stage hindered bed separator" and/or a "multi-stage teeter bed separator."

Figure 2:
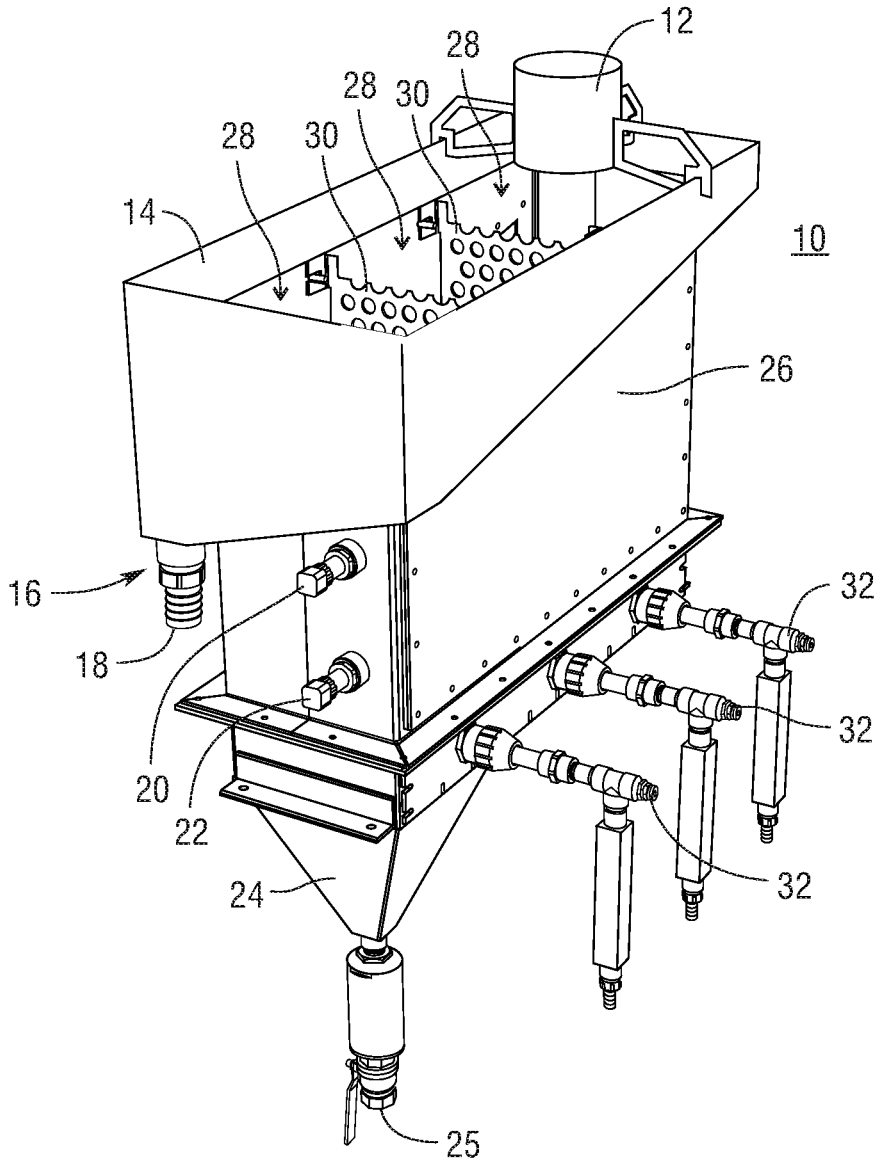
FIG. 2 shows a perspective view of the multi-stage fluidized-bed flotation separator.
Figure 3:
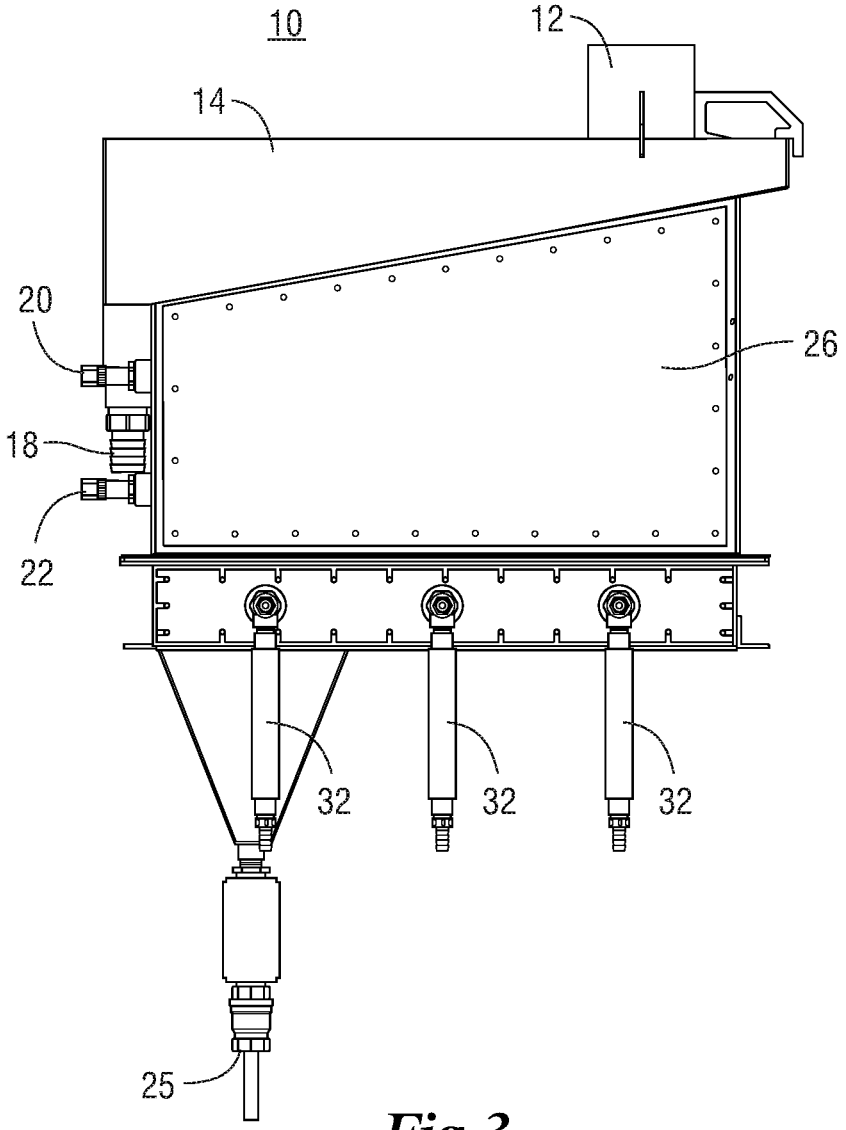
FIG. 3 shows a side view of the multi-stage fluidized-bed flotation separator of FIG. 2.

FIGS. 2 and 3 show a multi-stage fluidized-bed flotation separator system 10 (hereinafter "the separator system") for concentrating feed mixtures that are particulate mixtures of hydrophobic and hydrophilic material. A feed introducer 12 conveys the particulate mixture into the separator 10 for processing. An overflow launder 14 collects floated particles (described in more detail below) and teeter water (described in more detail below) and then directs their combined stream into a concentrate discharge 16, which directs the floated particles and teeter water to the downstream processes. The concentrate discharge 16 comprises a discharge nozzle 18.

A separation chamber 26 serves as the core processing unit for the entire separator system 10. The cross section of the separator system 10 is typically rectangular, but can also be, but is not limited to, round or square. The separation chamber 26 includes multiple processing compartments 28. In the embodiment shown in FIGS. 2 and 3, there are three processing compartments 28 separated by internal baffles 30. The baffles 30 can be designed such that the internal fluidization flow moves around, under, or through specially shaped pathways on each internal baffle. These pathways are designed to improve the mixing conditions within the separation chamber to affect a plug-flow regime. The number of processing compartments 28 can also be as few as two and as many as are necessary for the system.

In this embodiment, each processing compartment 28 is constructed accomplish any one of the following tasks, (1) size classification, (2) conditioning, (3) rougher separation process, and (4) scavenger separation process. In one example, without air and reagents, the processing compartment 28 which is closest to the feed introducer 12 can serve as a sizing or pre-conditioning compartment of the separation chamber 26. In this configuration it can be operated as a hindered settling device for size classification. This ultimately prepares the feed material in a preferred condition for the rougher processing stage. In certain applications, it is possible to reagentize the feed material in the pre-conditioning processing compartment 28 by introducing chemicals directly into the teeter water supply. The multiple processing compartment construction of the separator 10 allows each processing compartment to be independently operated under different teetering and aeration conditions, (such as a scavenger compartment, a rougher processing compartment, or the pre-conditioning compartment described earlier) which ultimately maximizes metallurgical performance. In certain applications, the pre-conditioning processing compartment 28 can also have an equivalent functionality to a rougher processing compartment, which will provide for additional scavenging steps within the separation chamber (useful in applications where the separation chamber 26 includes more than three compartments). At least one of the processing compartments 28, usually the pre-conditioning processing compartment that is the first processing compartment 28 in the series, can have a fluidization teeter water flow without air with the subsequent other processing compartments 28 having an aerated fluidization flow. It should be understood that none of the compartments need to be operated with air addition.

The overflow launder 14 is shown to be arranged around the entire perimeter of the separator system 10, but other configurations are possible such as independent overflow lauders for each processing compartment 28. The overflow from each compartment can be either combined as shown here or routed independently from each processing compartment 28. For example, the product from the first processing compartment 28 can be routed directly to another flotation separator operating in series, while the overflow from the remaining compartments can be routed elsewhere and/or across the separator, typically between each processing compartment 28.

The separator system 10 includes feed placed into the first processing compartment 28, though other feed arrangements are possible such as feed along the length or width of the separator system 10, at levels above or below the established teeter-bed. These feed systems can also incorporate pre-aeration systems. The feed system can also be placed off to the side of the initial processing compartment such that the impact of the introduction of the feed into the first processing compartment is minimized.

In this embodiment, the processing compartments 28 are each partitioned by internal baffles 30. The configuration and physical dimension of these internal baffles 30 can be arranged and designed to suit the different needs of different applications. One of ordinary skill in the art will see that the configuration of the processing compartments 28 (in essence the distance between two baffles 30, between a baffle 30 and one side of the separation chamber 26, underneath each baffle 30, or over each baffle 30) can be constructed in numerous arrangements and for different applications, in order to achieve maximum separation efficiency. As briefly mentioned above, it should also be understood that the number of compartments can vary, depending on the application of the separator 10 and the individual application of each compartment.

The basic operation of the separator system 10 is as understood in the art. A bed of suspended solids is fluidized into a teeter bed by the upward flow of teeter water through the suspended solids. Each processing compartment 28 has its own independent teeter water source 32. The teeter water comprises a mixture of water and air bubbles. A first pressure transducer 20 works in conjunction with a second pressure transducer 22 to control the teeter bed density by adjusting the flow rate of the teeter water entering the separator system 10. To adjust the flow rate of the teeter water, the measurement signals from the first pressure transducer 20 and second pressure transducer 22 are provided to a density indicating controller (not shown) where the calculated density is determined. Teeter water is added or detracted in order to maintain a constant bed-density or degree of teeter-bed expansion. In addition, the second pressure transducer 22 also feeds back teeter bed level information to a level indicating controller to regulate the flow from the underflow discharge valve for a continuous and steady state operation. A skilled artisan will see that other level and density control systems, including a float-target or siphon approach, are possible. It is also possible to adjust teeter bed density using a single pressure transducer.

Hydrophobic particles within the particular mixture interact with the air bubbles in the teeter water and either remain above the fluidized teeter bed or are carried along with some teeter water into the overflow launder 14 and are collected out of the system. Hydrophilic particles within the particulate mixture cannot attach to the bubbles and pass through the fluidized teeter bed. Gravity causes this material to gradually migrate downward and report to the dewatering compartment 24 under the hindered settling region. The processed feed then discharges through an underflow valve 25 located at the bottom of the dewatering compartment 24.

Figure 4:
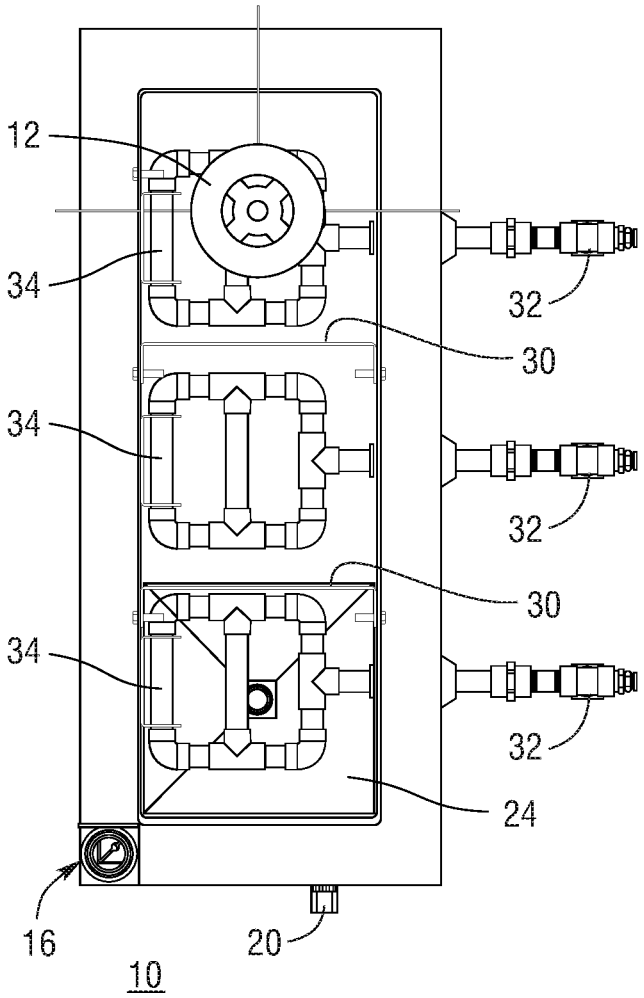
FIG. 4 shows a top view of the multi-stage fluidized-bed flotation separator of FIG. 2.
Figure 5:
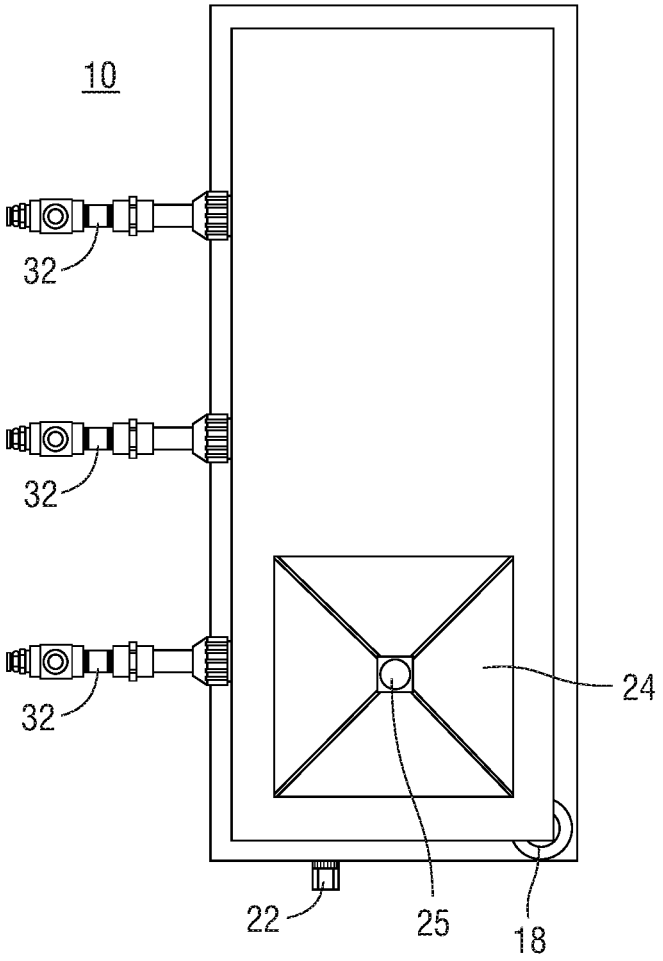
FIG. 5 shows a bottom view of the multi-stage fluidized-bed flotation separator of FIG. 2.

As can be seen in FIG. 4, the teeter water source 32 for each processing compartment 28 comprises a manifold 34 positioned in the separation chamber 26 and above the dewatering compartment 24. Each manifold is arranged to distribute teeter water and air throughout its respective processing compartment 28 in the separation chamber 26. The teeter water source 32 includes separate water and aeration control for each processing compartment 28. Independent operation of each teeter water source 32 is possible such that, if conditions warrant, chemical additives could be added to any of the processing compartments 28. Additionally, the teeter water flow rate or the air flow rate could be independently controlled. As best understood by comparing FIGS. 3, 4, and 5, in this embodiment, it can be seen that the dewatering compartment 24 is positioned under the last processing compartment 28 in series in the body of the separation chamber 26. Each additional processing compartment 28 following the first provides increased particle retention time in the separator system 10 by permitting the particles to move laterally and vertically through each processing compartment 28.

The separator system 10 shown and described negates the need to maintain completely independent fluidized-bed flotation separator operations. Instead of having two fluidized-bed flotation separator units positioned in series (or any number of independent fluidized-bed flotation separator units positioned in series), either using gravity flow or through mechanical conveyance, the separator system 10 shown and described uses the processing compartments 28 to mimic in-series flotation separator circuitry within a single low-profile fluidized-bed flotation separator.

The separator system 10 drastically reduces the needed footprint and elevation required for an equivalent number of fluidized-bed flotation separators in series. The same recovery as multiple in-series flotation separation units can be achieved in a single separation chamber 26 (based on equations above).

The arrangement described above can be extended to cover typical teeter-bed or fluidized-bed separators operated without air which can be used for density concentration or classification (i.e., teeter-bed separators). This separator system 10 can be considered for both a density and flotation separation applications as the attachment of air bubbles and the subsequent separation is based both on density differentials and flotation fundamentals.

Figure 6:
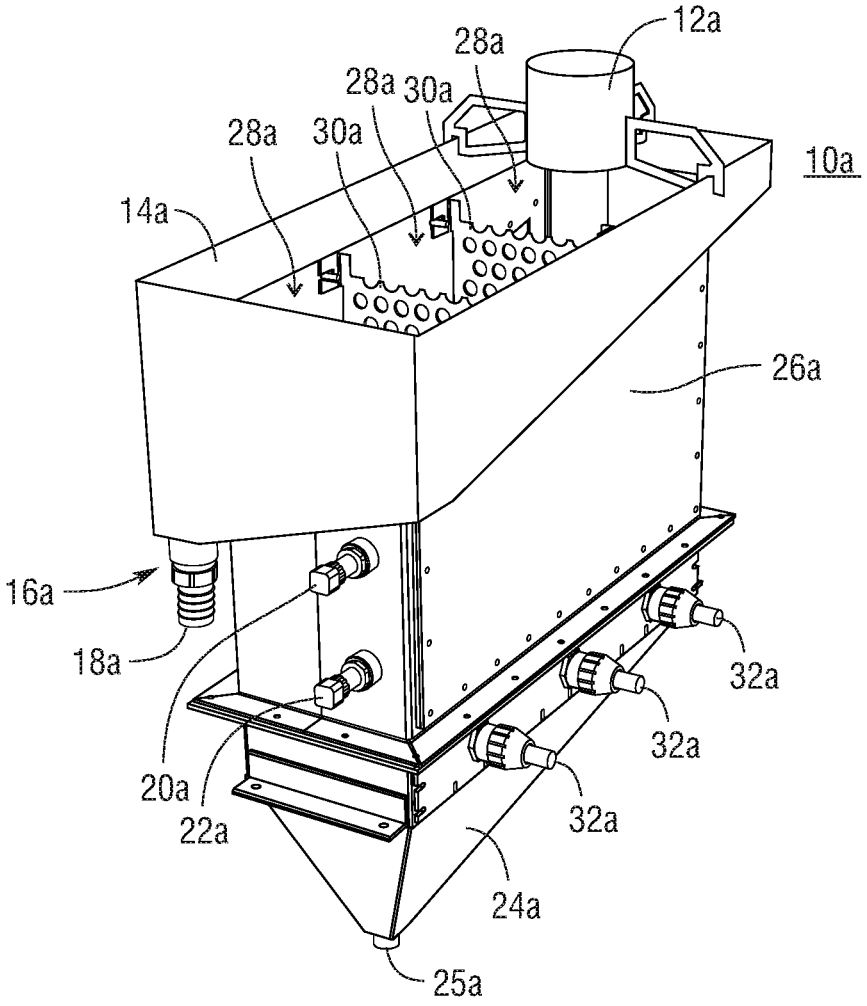
FIG. 6 shows a perspective view of another embodiment of a multi-stage fluidized-bed flotation separator.
Figure 7:
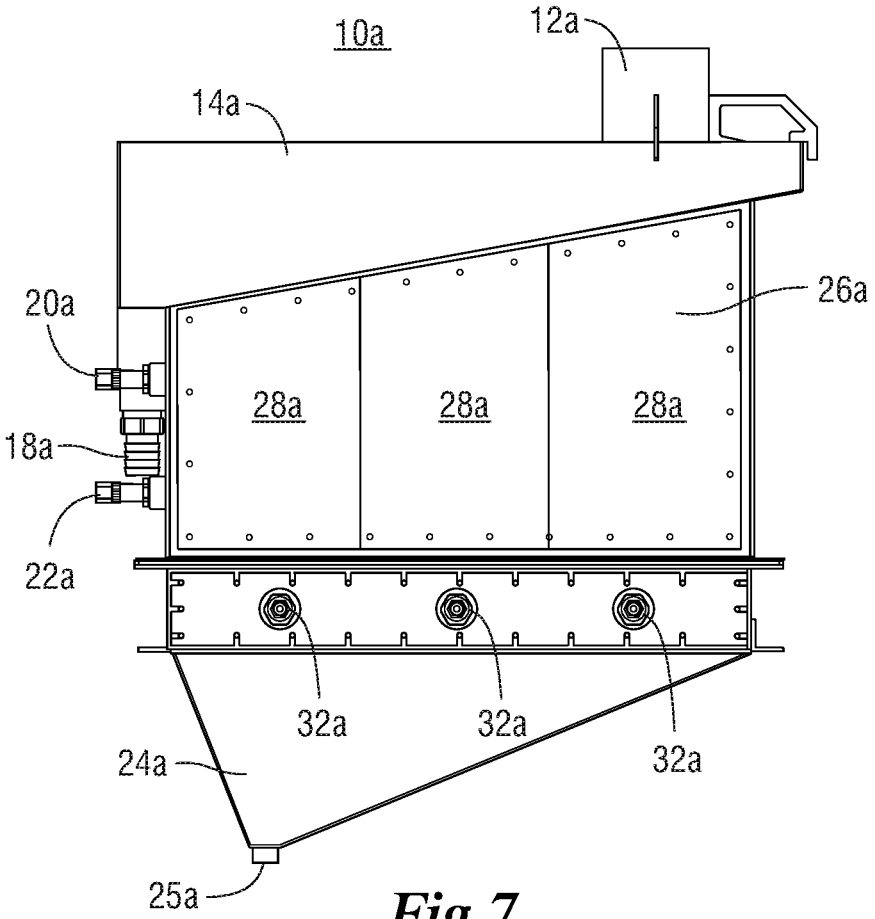
FIG. 7 shows a side view of the multi-stage fluidized-bed flotation separator of FIG. 6.
Figure 8:
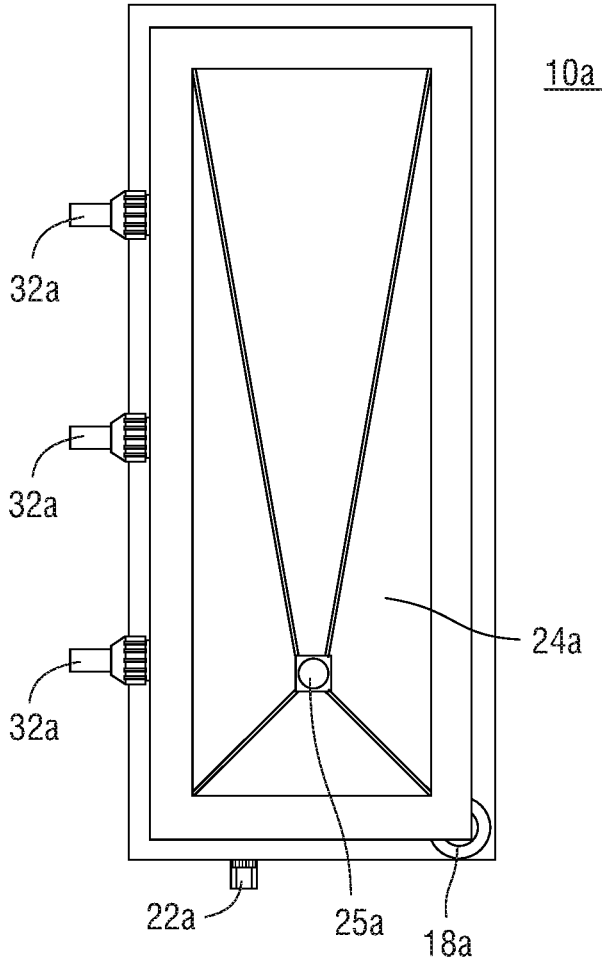
FIG. 8 shows a bottom view of the multi-stage fluidized-bed flotation separator of FIG. 6.

The separator system 10 shown in FIGS. 2 through 5 includes a flat-bottom arrangement for all processing compartments 28 except for the final processing compartment, which incorporates the dewatering compartment 24. However, other embodiments are possible. FIGS. 6-8, show another embodiment of the separator system 10*a* in which the dewatering compartment 24*a* is an off-center inverted pyramid shape that peaks at the tailing valve 25*a*. In this embodiment, the dewatering compartment 24*a* extends across the entire separation chamber 26 and under every processing compartment 28*a*. This embodiment has three processing compartments 28*a*. Another embodiment, not shown would be for the bottom of the system to be completely flat with a dewatering drain exiting the system at one end.

Figure 9:
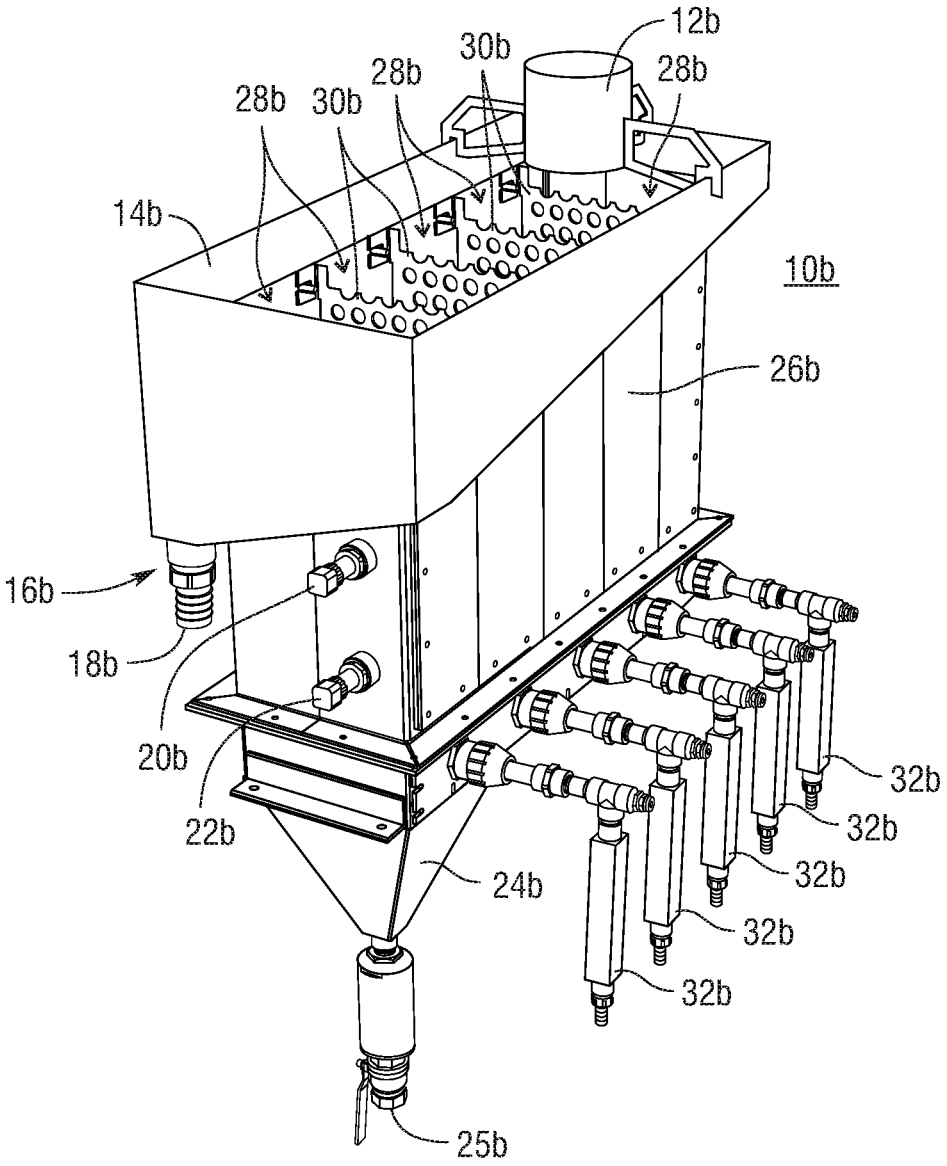
FIG. 9 shows a perspective view of another embodiment of a multi-stage fluidized-bed flotation separator having five processing compartments.

It will be understood that the number of processing compartment can also be varied in different embodiments. FIG. 9 shows an embodiment of separator system 10*b* that has five processing compartments 28*b* and four internal baffles 30*b*. The number of processing compartments is virtually unlimited.

Figure 10:
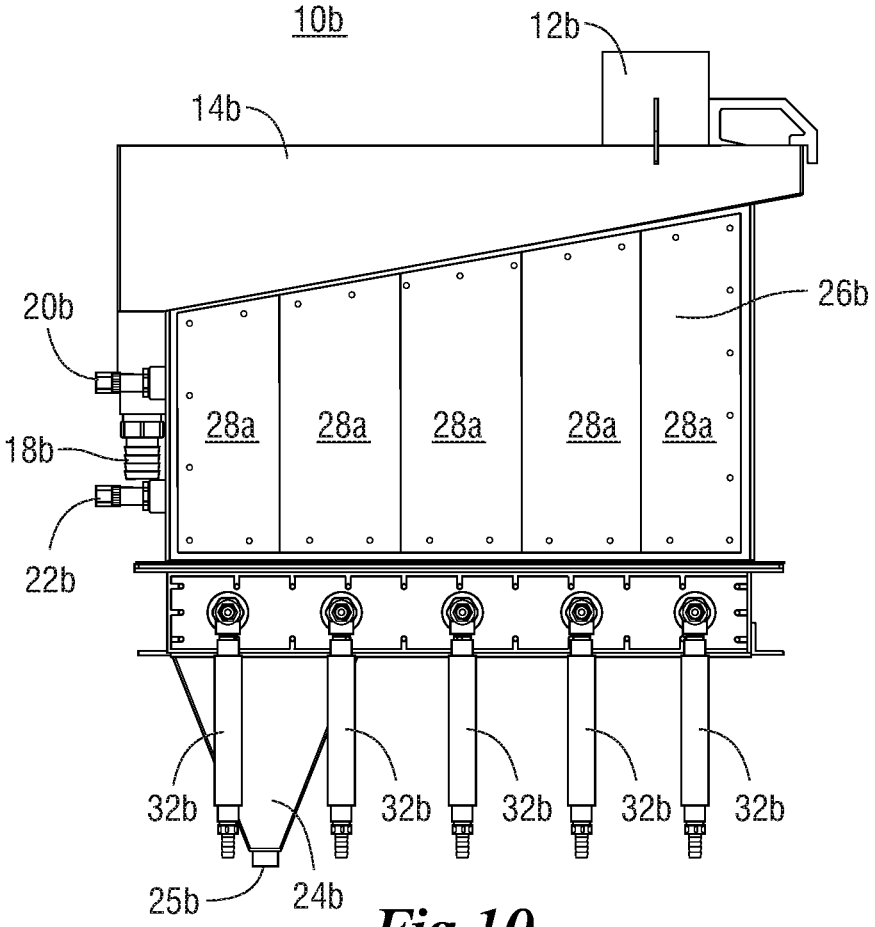
FIG. 10 shows a side view of the multi-stage fluidized-bed flotation separator of FIG. 9.
Figure 11:
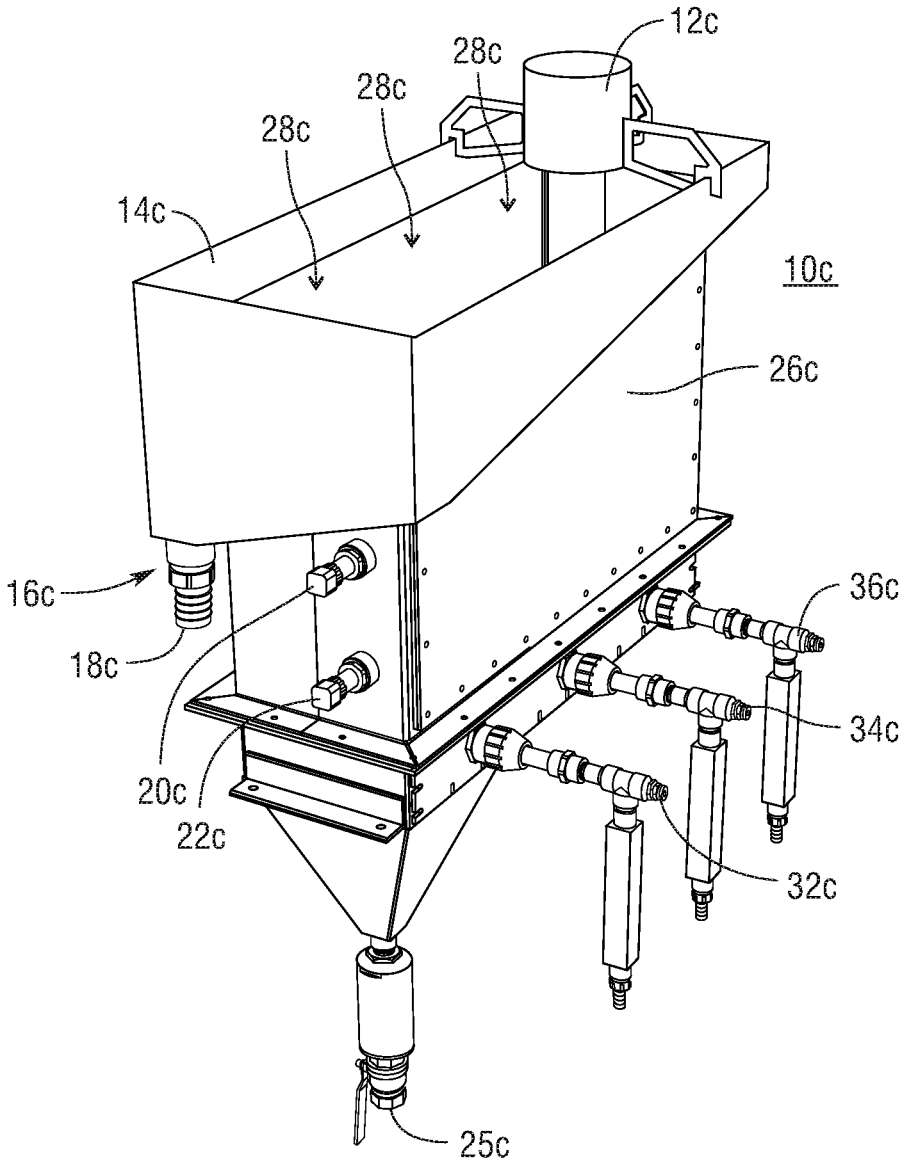
FIG. 11 shows a perspective view of another embodiment of a multi-stage fluidized-bed flotation separator that does not include any internal baffles.

FIG. 10 illustrates an embodiment of separator system 10*c* in which the processing compartments 28*c* are not delineated by baffles and the separator system 10*c* operates as an open trough. This illustrates that the operating condition of each processing compartments 28*c* is controlled by the teeter water sources 32*c* and that the baffles in other embodiments are not required to delineate each processing compartment 28*c*.

While the embodiments shown all have baffles that have openings within them, it will be understood that the number and configuration of baffles is not fixed. The baffles need not extend along the entire length of the processing compartments and the size of the openings is not fixed. Indeed, the baffles are entirely optional and may be removed or not included at all.

The embodiments shown have the processing compartments arranged linearly and in a generally straight line configuration. However, it will also be understood that as the number of processing compartments is increased, the arrangement of sequential processing compartments could be in something other than a straight line. It could be envisioned that a string of processing compartments could be arranged in a non-liner or circular pattern and achieve the same results. In addition, the flow of particles could be split into parallel treatment streams with particulate recovery occurring in parallel processing compartments.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

What is claimed is:

1. A system for concentrating particulate mixtures of hydrophobic and hydrophilic material in a fluid medium comprising:

a separation chamber comprising two or more processing compartments in series, wherein each processing compartment comprises:

a manifold for the introduction of teeter water;

suspended solids that form a fluidized bed that is created and regulated by the upward movement of said teeter water through said suspended solids;

each said processing compartment is independently operable; and air is added to said teeter water in at least one said processing compartment;

a feed introducer for conveying the particulate mixture of hydrophobic and hydrophilic materials in the fluid medium into the first said processing compartment;

an overflow launder above said separation chamber; and a dewatering compartment beneath said separation chamber;

wherein the particulate mixture of hydrophobic and hydrophilic materials are concentrated by interacting with said fluidized bed and said air in said teeter water such that hydrophobic particles attach to said air and report above the fluidized bed and to said overflow launder and hydrophilic particles pass through said fluidized bed and move into said dewatering compartment.

2. The system of claim 1 further comprising internal baffles separating each said processing compartment.

3. The system of claim 1 further comprising said dewatering chamber extending under every said processing compartment in said separation chamber.

4. The system of claim 1 further comprising said dewatering chamber extending under only the last said processing compartment in the series.

5. The system of claim 1 further comprising introducing chemical additives to one or more of said processing compartments.

6. The system of claim 1 further comprising a first pressure transducer and a second pressure transducer located within said fluidized bed of at least one said processing compartment in said separation chamber for controlling the density of the fluidized bed within said at least one processing compartment in said separation chamber.

7. The system of claim 1 further comprising said processing compartments arranged in a non-linear series.

8. The system of claim 1 further comprising said processing compartments arranged in a straight line.

9. The system of claim 1 in which said teeter water comprises a mixture of water and air bubbles.

10. The system of claim 1 in which the teeter water comprises water.

11. The system of claim 1 in which each said processing compartment is independently operated to perform any one the following tasks: size classification, conditioning, rougher separation, and scavenger separation.

12. A method for concentrating mixtures of hydrophobic and hydrophilic particles in a fluid medium comprising:

introducing mixtures of hydrophobic and hydrophilic particles and fluid medium into a separator system that comprises two or more processing compartments, wherein each processing compartment contains suspended solids that form a fluidized bed created and regulated by the upward movement of teeter water through the suspended solids and air is added to the teeter water in at least one of the processing compartments;

allowing the hydrophobic and hydrophilic particles to experience targeted separation conditions by adjusting the teetering condition in each processing compartment;

concentrating the hydrophobic and hydrophilic particles by permitting the hydrophobic and hydrophilic particles to interact with the fluidized bed and the air in the teeter water such that hydrophobic particles attach to the air bubbles and report to the upper portion of the separator system above the fluidized bed and hydrophilic particles pass through the fluidized bed and move into the lower portion of the separator system;

providing increased particle retention time in the separator system by permitting the hydrophobic and hydrophilic particles to move laterally and vertically through each processing compartment in the separator system;

removing hydrophobic particles at the upper portion of the separator system; and removing hydrophilic particles at the lower portion of the separator system.

13. The method of claim 12 further comprising adding chemical additives to one or more processing compartments.

14. The method of claim 12 in which the teeter water comprises a mixture of water and air bubbles.

15. The method of claim 12 in which the teeter water comprises water.

16. The method of claim 12 in which the targeted separation conditions in each said processing compartment is any one of size classification, conditioning, rougher separation, and scavenger separation.

* * * * *